United States Patent [19]

Durant

[11] 4,411,296

[45] * Oct. 25, 1983

[54] VALVE BAG PLACER

[75] Inventor: Will G. Durant, Tustin, Calif.

[73] Assignee: W. G. Durant Corporation, Placentia, Calif.

[ * ] Notice: The portion of the term of this patent subsequent to Jun. 15, 1999, has been disclaimed.

[21] Appl. No.: 253,978

[22] Filed: Apr. 13, 1981

Related U.S. Application Data

[63] Continuation-in-part of Ser. No. 155,920, Jun. 3, 1980, Pat. No. 4,334,558.

[51] Int. Cl.[3] ..... B65B 43/18; B65B 43/30

[52] U.S. Cl. ..... 141/98; 53/131; 141/68; 141/114; 141/166

[58] Field of Search ..... 53/570, 571, 131; 141/10, 67, 68, 94, 114, 165, 166, 171, 173, 315, 98; 221/11; 414/113, 118, 121; 101/35, 36, 41; 493/188

[56] References Cited

U.S. PATENT DOCUMENTS

| | | | |
|---|---|---|---|
| 3,358,414 | 12/1967 | Hersh et al. | 101/35 X |
| 3,785,414 | 1/1974 | Obara | 141/114 |
| 4,128,116 | 12/1978 | Uthoff et al. | 141/114 X |

*Primary Examiner*—Frederick R. Schmidt

*Attorney, Agent, or Firm*—Fischer, Tachner & Strauss

[57] ABSTRACT

A bag placer apparatus for placing a valve bag upon a filler spout through which the bag is to be filled with a flowable material. The apparatus comprises three principal components, namely, a magazine for stacking the bags, a registration and indexing apparatus for removing one bag at a time from the stack and aligning the bag with the valve portion thereof in a precise location, and a picker-spouter apparatus which picks up the aligned bag, opens the valve and places it upon a filler spout. The picker-spouter apparatus includes an advantageous combination of clamp mechanism, suction cups, a push rod, and a second clamp mechanism which employs a pair of leaf-springs which selectively grasp and align the vertical edge of each bag below the valve thereof to further ensure proper bag alignment and valve opening.

A novel bag printer assembly is provided to permit the user to automatically print a selected code, indicia or other writing on each bag and especially on the bottom of each bag as it is being handled by the bag placer. This printer assembly is structurally integrated into the registration and indexing apparatus and electrically and pneumatically integrated into the overall system whereby printing on each bag is automatically accomplished.

10 Claims, 11 Drawing Figures

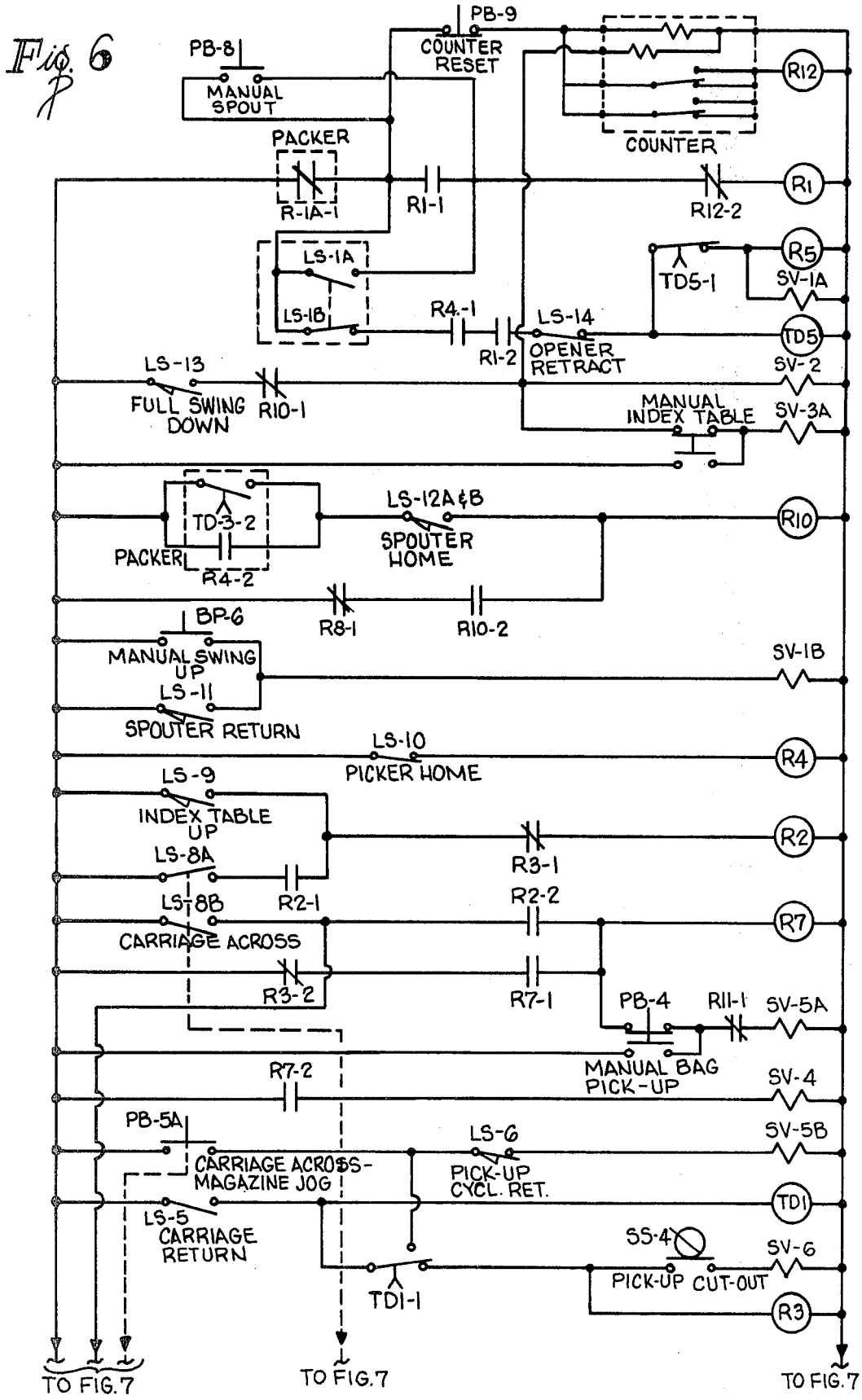
Fig. 6
PB-8
MANUAL SPOUT
PB-9
COUNTER RESET
COUNTER
R12
PACKER
R-1A-1
R1-1
R12-2
R1
LS-1A
LS-1B
R4-1
R1-2
LS-14
OPENER RETRACT
TD5-1
R5
SV-1A
TD5
LS-13
FULL SWING DOWN
R10-1
SV-2
MANUAL INDEX TABLE
SV-3A
TD-3-2
PACKER
R4-2
LS-12A&B
SPOUTER HOME
R10
R8-1
R10-2
BP-6
MANUAL SWING UP
LS-11
SPOUTER RETURN
SV-1B
LS-10
PICKER HOME
R4
LS-9
INDEX TABLE UP
LS-8A
R2-1
R3-1
R2
LS-8B
CARRIAGE ACROSS
R2-2
R7
R3-2
R7-1
PB-4
R11-1
SV-5A
MANUAL BAG PICK-UP
R7-2
SV-4
PB-5A
CARRIAGE ACROSS-MAGAZINE JOG
LS-6
PICK-UP CYCL. RET.
SV-5B
TD1
LS-5
CARRIAGE RETURN
SS-4
PICK-UP CUT-OUT
SV-6
TD1-1
R3
TO FIG.7
TO FIG.7
TO FIG.7

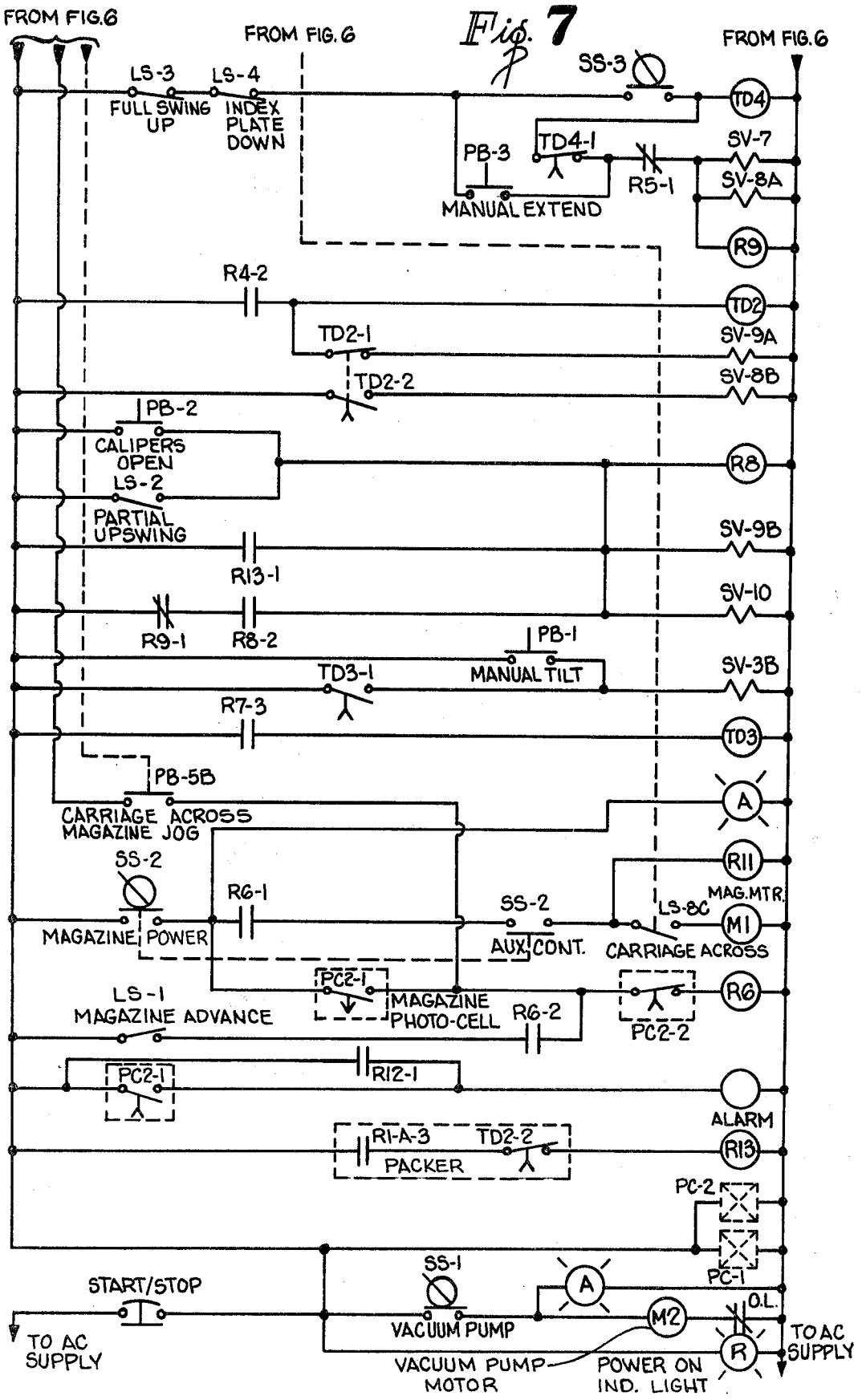
Fig. 7
FROM FIG.6
FROM FIG. 6
FROM FIG.6
LS-3
LS-4
FULL SWING UP
INDEX PLATE DOWN
SS-3
TD4
PB-3
TD4-1
R5-1
SV-7
SV-8A
MANUAL EXTEND
R9
R4-2
TD2
TD2-1
SV-9A
TD2-2
SV-8B
PB-2
CALIPERS OPEN
R8
LS-2
PARTIAL UPSWING
SV-9B
R13-1
SV-10
R9-1
R8-2
PB-1
MANUAL TILT
TD3-1
SV-3B
R7-3
TD3
PB-5B
CARRIAGE ACROSS MAGAZINE JOG
A
SS-2
R11
R6-1
SS-2
LS-8C
MAG.MTR.
M1
MAGAZINE POWER
AUX. CONT.
CARRIAGE ACROSS
PC2-1
LS-1
MAGAZINE ADVANCE
MAGAZINE PHOTO-CELL
R6-2
PC2-2
R6
PC2-1
R12-1
ALARM
R1-A-3
TD2-2
PACKER
R13
PC-2
PC-1
SS-1
START/STOP
A
O.L.
M2
VACUUM PUMP
TO AC SUPPLY
R
TO AC SUPPLY
VACUUM PUMP MOTOR
POWER ON IND. LIGHT 64
57
57
58
72
72
65
73
73
56
77
54
54
78
75
75
74
74
76
76
84
80
80
84
82
82

VALVE BAG PLACER

CROSS REFERENCE TO RELATED APPLICATION

This is a continuation-in-part of application Ser. No. 155,920 filed June 3, 1980 now U.S. Pat. No. 4,334,558.

BACKGROUND OF THE INVENTION

1. Field of the Invention

The present invention relates to apparatus for automatically placing valve bags onto a filler spout to be filled thereby. More specifically, the present invention relates to an automatic suspension for placing valve equipped bags upon the spout of a filling apparatus through which the bags may be filled with flowable particulate material.

Valve bags are of the type that comprise a top which is open at one end so as to be able to receive the filling spout of a filling machine. The principal advantage of such bags is that they close automatically when filled and removed from the machine so that no special sealing procedures are needed to close the bags at their top subsequent to their being filled.

2. Prior Art

Because of the manifest disadvantages of manually placing the open valve end of one bag at a time on the filling spout of a filling machine, a substantial prior art has developed disclosing a plurality of sequentially controlled apparatus for performing the indicated valve bag placement operation automatically. By way of example, the following table lists a number of issued patents disclosing apparatus of the type indicated:

TABLE I

| U.S. Pat. No. | Inventor |
|---|---|
| 2,548,075 | Stoker |
| 2,828,596 | Dowty et al |
| 3,053,027 | Frost |
| 3,213,588 | Peterson |
| 3,225,515 | Inglett |
| 3,287,879 | Miller |
| 3,312,038 | Knauf |
| 3,423,903 | Miller |
| 3,462,917 | Nakashima |
| 3,466,837 | Sturges |
| 3,522,691 | Adcox |
| 3,691,715 | Kelly et al |
| 3,715,858 | Durant et al |
| 3,785,414 | Obara |
| 3,884,278 | Nakashima |
| 3,986,322 | Taylor |
| 3,989,073 | Remmert |
| 4,019,546 | Hastrup |
| 4,128,116 | Uthoff et al |

Unfortunately, each of the prior art patents listed in Table I discloses an apparatus which suffers from one or more disadvantages that renders it less desirable in some aspect of its operation. For example, the aforementioned prior art devices may have proved satisfactory in handling only valve bags of the type comprising heavy multi-ply paper, which bags inherently have a substantial degree of structural stiffness that renders them relatively easy to stack and manipulate. However, none of such devices known to applicant is capable of satisfactorily handling valve bags of the type made of lightweight plastic. Such plastic valve type bags are highly advantageous because of their lower cost, lighter weight and increased resistance to contamination by moisture or leaks of the contained particulate matter. However, until applicant's present invention, such plastic bags have constituted a problem for the manufacturers of bag placer apparatus because of the inherently increased difficulty of handling such highly flexible plastic materials. The tendency of plastic valve bags to flex in their centers renders such bags especially difficult to stack in a vertical pile without the centers thereof forming a concave shape, the curvature of which increases in proportion to the number of bags in the stack. Furthermore, many prior art devices for automatically applying valve bags to filler spouts, require that the bags be placed in a horizontal stack in which their weight is supported substantially along one edge. This is perfectly acceptable for the stiff conventional paper bags referred to above, but plastic valve bags do not have the structural rigidity to permit support of the valve bag weight on one edge with the bag in a substantially flat vertical plane. As a result, plastic valve bags are simply not acceptable in any prior art bag placer apparatus that utilizes horizontally directed stacks of bags, and are of at least highly questionable applicability even in apparatus using vertical stacks of bags.

Thus, the inability of prior art devices known to applicant to handle the more modern, lighter weight and less costly plastic valve bags, is a highly significant disadvantage which renders all such prior art devices substantially obsolete and inappropriate for their intended purpose in conjunction with plastic valve bags.

Another substantial disadvantage of prior art valve bag placing apparatus is that although manual labor is not required to place the bag on the filling spout, a certain amount of time-consuming care must be utilized to stack the bags within very limited position tolerances so that the individual bags in such stacks will be appropriately placed to be received by the prior art apparatus for automatic placement on the filling spout. As a result of the special additional care that must be utilized in forming the stack, a portion of the cost and time-saving advantage provided by the automatic apparatus is lost.

Still a further disadvantage of prior art automatic apparatus for placing valve bags is the reliability of the mechanism used in such apparatus for opening the valve end of the bag as required to ensure positive placement of the open valve portion on the filler spout. Such reliability is needed to prevent particulate material from being poured onto the ground or otherwise poured outside the bag, and so that only a trivial number of bags are inadvertently caused to miss the spout and fall empty on the floor or conveyor belt below the filling spout.

SUMMARY OF THE INVENTION

The present invention utilizes a unique combination of apparatus to provide an automatic valve bag placer system that eliminates or substantially reduces the aforementioned disadvantages of the prior art. The invention utilizes a combination of a magazine having a plurality of horizontal platforms, a transfer and indexing apparatus that transfers one bag at a time from the magazine to a position above an indexing table, and drops the bag onto that table where its registration is automatically adjusted to be appropriate for the third apparatus in the combination, namely, a picker-spouter, which picks up the bag, opens the valve and places the bag valve upon the filler spout.

As a result of the unique manner in which the valve bags are handled in the present invention, the aforementioned major disadvantages of prior art apparatus, namely, their inability to place plastic valve bags, is eliminated in the present invention. In addition, because the present invention is the only one known to applicant which actually releases the bag and allows it to fall freely onto an indexing table for proper registration with respect to the picker-spouter, in the present invention stacking of the bags on the magazine need not be accomplished with the care and accuracy required in prior art devices. In other words, as long as the valve of each valve bag is pointed generally towards the same corner of the horizontal platforms of the magazine of the present invention, the precise alignment of the bags is not critical because the precise registration of each bag is accomplished by means of the transfer and indexing apparatus as will be hereinafter more fully understood.

The picker-spouter apparatus of the present invention utilizes a unique combination of suction cups, clamps, and a push rod which combine to provide a substantial increase in the reliability in regard to the opening of the valve and the placement of the valve bag onto the filler spout in a secure manner, thus assuring that all the particulate material is properly placed only inside the bag and furthermore, that virtually none of the bags falls empty to otherwise diminish the efficiency of the process performed by the invention. In one additional embodiment of the invention, a second set of clamps having leaf-springs therebetween is utilized to further increase the bag valve opening reliability. In still an additional embodiment, a novel bag printer apparatus is employed to automatically print information on the bag surface.

OBJECTS

It is therefore a primary object of the present invention to provide an improved apparatus for placing valve bags on the filling spout of a filling machine, which apparatus substantially overcomes or entirely eliminates the noted disadvantages of prior art devices.

It is a further object of the present invention to provide an improved automatic valve bag placing apparatus which, in addition to providing means for handling valve bags of the conventional multi-ply stiff paper construction, is also capable of handling plastic valve bags or valve bags of other material of highly flexible structure.

It is still a further object of the present invention to provide an automatic valve bag placer that includes means for registering each bag on an indexing apparatus whereby the otherwise stringent requirements for uniform stacking of such bags is substantially obviated.

It is still a further object of the present invention to provide an improved valve bag placing system including a picker-spouter apparatus having substantially more reliable means for positively opening the valve mechanism of the bag and for placing the valve bag on the spout of a filling machine with increased reliability.

It is still a further object of the present invention to provide an improved valve bag placing system including means for automatically printing selected information on each bag before it is placed on the filling spout.

BRIEF DESCRIPTION OF THE DRAWINGS

The above indicated advantages and objects of the present invention as well as additional advantages and objects will be more fully understood hereinafter as a result of the detailed disclosure of the invention taken in conjunction with the accompanying drawings in which:

FIGS. 6 and 7 are schematic circuit diagrams of the invention;

DETAILED DESCRIPTION OF A PREFERRED EMBODIMENT

Figure 2:
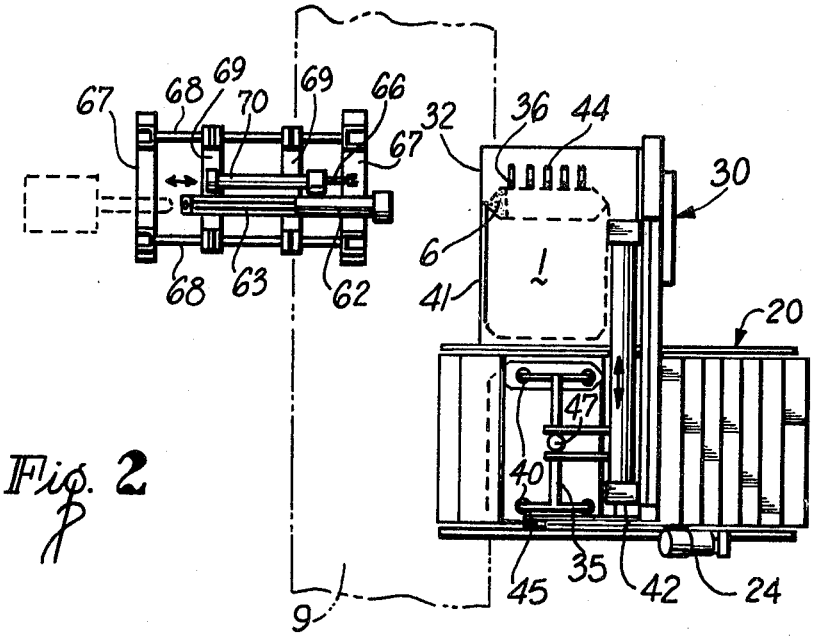
FIG. 2 is a top view of the invention, and in conjunction with FIG. 1 illustrates the general flow of bag handling steps involved.
Figure 1:
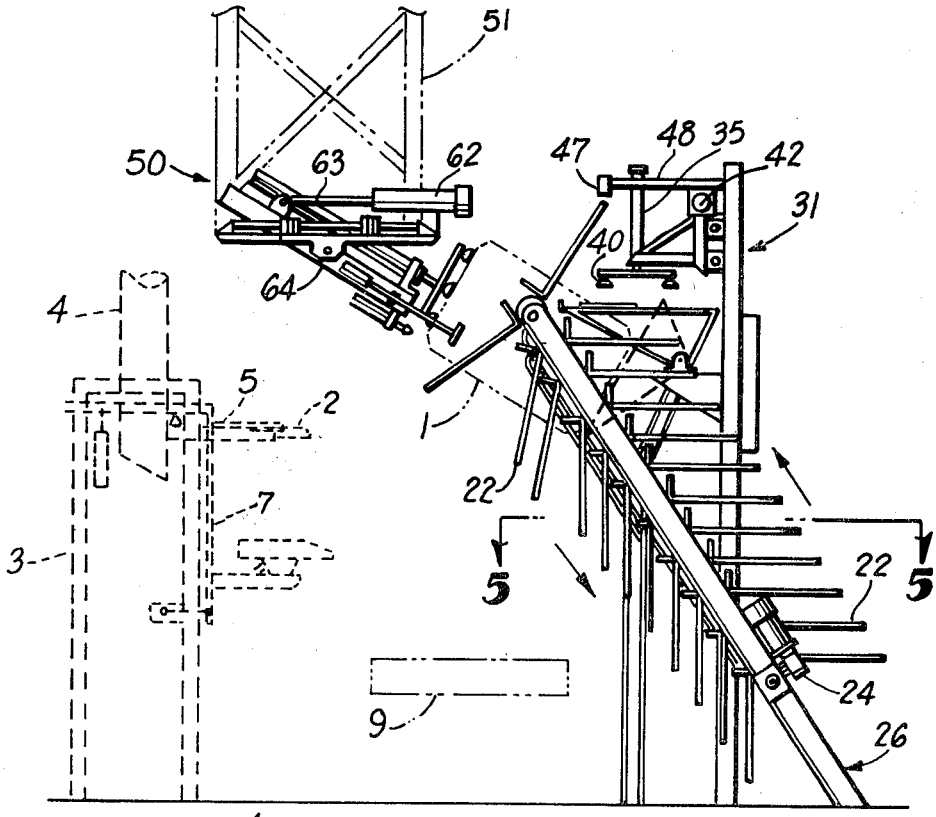
FIG. 1 is a front view of a preferred embodiment of the invention.
Figure 3:
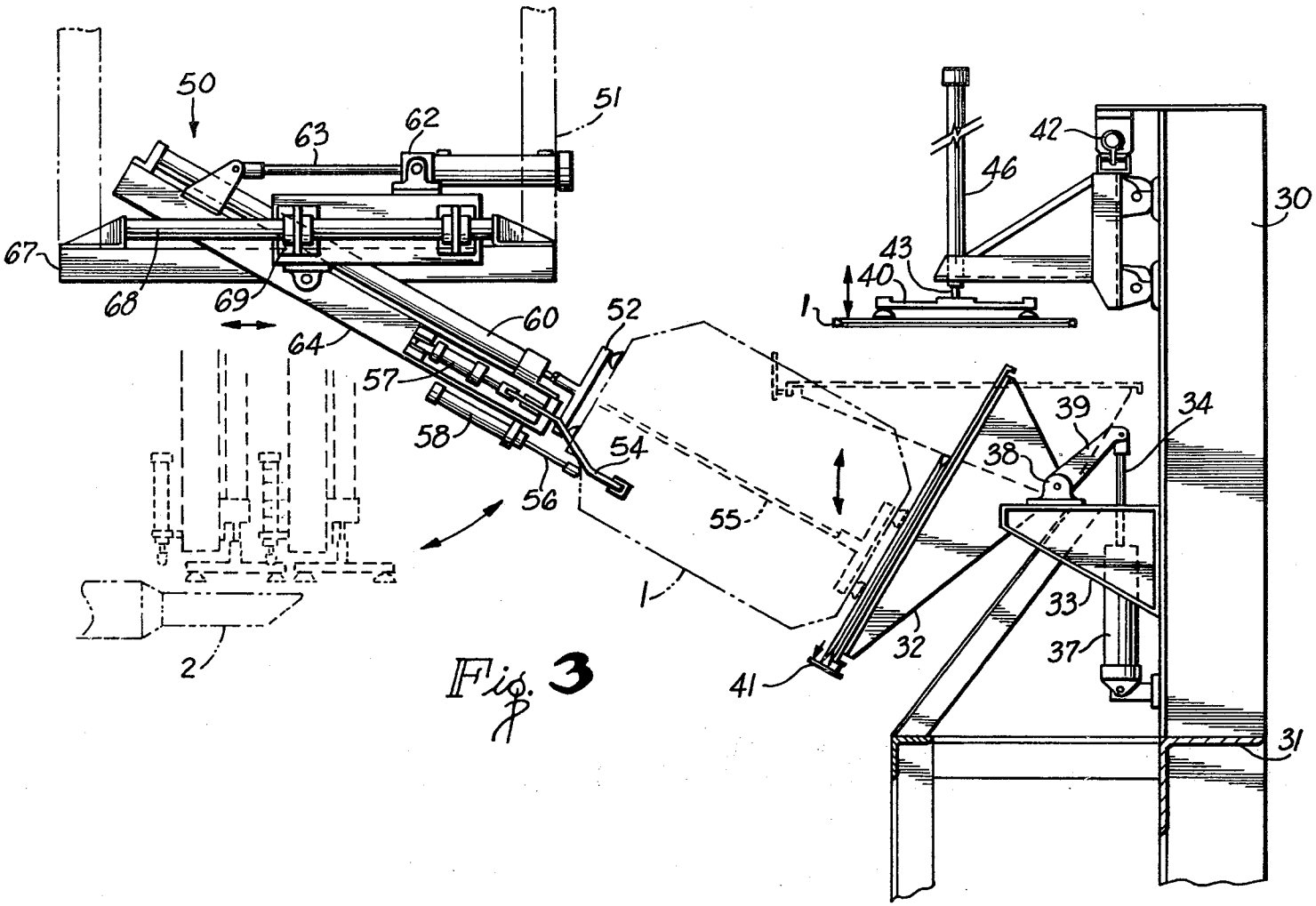
FIG. 3 is a more enlarged front view of the transfer and indexing apparatus and of the picker-spouter apparatus of the invention.

The general features of the present invention and the manner in which valve bags are manipulated by and transferred from one such apparatus to another, will be readily understood from the following description of FIGS. 1 through 3.

As shown in FIG. 1, the bag placer of the present invention automatically places a valve bag 1 on a packer filling spout 2 so that the bag may be filled thereby with a flowable material such as a particulate solid or a liquid. Spout 2 is affixed to a fill structure 3 which includes a filling mechanism 4 which is adapted to transfer the flowable material to the bag from a source of such material not shown.

Because of the automatic nature of the invention it will be understood that it is desirable to also automate the filling process after the bag has been placed on the spout, while preventing any spillage or only partial filling of a bag which would detract from the benefits provided by the present invention. Accordingly, it is typical to use the present invention with a filling mechanism that also includes a sensing device 5 in proximity to the spout 2 for the purpose of starting the flow of the particulate solid or other such flowable material only after a valve bag 1 has been placed securely on the spout.

Also shown in FIG. 1 is a scale 7 attached to the fill structure 3 for the purpose of weighing each of the bags as it is being filled so that the flow of material into the bags can be terminated when a precise weight of material has been injected into the bag. When the scale registers a precise weight, dependent upon the density of the material and the volume of the bag, a device for ejecting the filled bag onto a conveyor belt 9, but not shown in the drawing, would automatically commence operation, freeing spout 2 for the next empty bag to be placed thereon by the present invention.

It will be understood that the valve bags, the means for filling the bag for sensing the appropriate weight of the contents thereof, and for ejecting and conveying the filled bag from the filling structure, may be conventional in nature, but in any case do not constitute features of the present invention.

The bag placer of the present invention 10 includes three principal apparatus, namely, magazine apparatus 20, transfer and indexing apparatus 30, and picker-spouter apparatus 50. It will be understood that in the accompanying figures, a valve bag 1 is shown in a variety of configurations during the sequence of operation whereby each valve bag is eventually placed upon spout 2.

Magazine apparatus 20 may be considered the first apparatus of the combination comprising the present invention because it is the means for receiving vertical stacks of horizontally placed bags, each such bag being positioned on a shelf 22 of which there are a plurality rotatably affixed to a shelf conveyor apparatus 26. A gear motor 24 provides the force needed to effect movement of shelf conveyor apparatus 26 as indicated by the arrowheads in the right-most portion of FIG. 1. Such movement is utilized intermittently to position a stack of valve bags into proper registration with the remaining portions of the invention.

As will be more fully understood hereinafter, one bag at a time is removed from each such stack while the magazine apparatus 20 remains stationary. Ultimately, when the last bag on the upper-most horizontal shelf 22 is removed for placement by the invention on spout 2, a photoelectrical sensing device 47, positioned by sensor arm 48 vertically elevated from and in alignment with the upper-most shelf from which the bags are being removed, senses that the last such bag has been removed and causes motor 24 to be activated whereby shelf conveyor apparatus 26 positions the next horizontal shelf into proper alignment with the remaining portions of the invention. Simultaneously, the newly emptied shelf is positioned out of the way so that it does not obstruct the continuing bag placement process. As shown in FIG. 1, the emptied shelves are eventually rotated to the underside of shelf conveyor apparatus 26 into a freely hanging vertical position where the sequence of operation of magazine apparatus 20 eventually re-positions the emptied shelves into horizontal configurations to receive additional stacks of empty valve bags.

It will be seen hereinafter that because of the novel operation of the present invention, the various stacks of valve bags placed respectively on the plurality of shelves 22 of magazine apparatus 20, need not be as precisely aligned in position as prior art devices have required. As a result, less time and effort are required to properly stack bags in position for handling by the invention and the reliability of the bag placing process performed by the present invention is substantially enhanced. Furthermore, bag placement is rendered virtually independent of the degree of care used by the loading personnel in placing the bag stacks onto the magazine apparatus 20.

The apparatus that assures precise registration of each bag for reliable placement thereof on the spout 2, is the transfer and indexing apparatus 30. Apparatus 30 includes a support structure 31 to which an indexing table or plate 32 is rotatably affixed by means of a fixed table support bracket 33. Indexing table 32 is adapted to be tilted from a substantially horizontal position, shown in dotted lines in FIG. 3, to a position that is approximately 60° below the horizontal by being rotated or tilted counterclockwise as viewed in FIG. 3 about a fulcrum point 38. A table tilt extension arm 34 and a lever arm 39 effect rotation of tilt table 32 about fulcrum point 38 when actuator 37 places arm 34 into the fully extended position as shown in FIG. 3. Tilting table 32 provides registration of each valve bag along one dimension of table 32 by sliding the bag into contact with an indexing lip 41 in the direction of the adjacent arrowhead shown in FIG. 3.

Registration of a valve bag on indexing table 32 in the second dimension, that is, registration in the direction perpendicular to the registration achieved by bracket 41, is accomplished by means of indexing fence 36 which is seen best in FIG. 2. FIG. 2 provides a top view of tilt table 32 in its horizontal position. Indexing fence 36 moves linearly back and forth, within corresponding slots 44 as indicated by the arrowhead adjacent the slots as shown in FIG. 2. Thus, in order to achieve the indexing placement provided by fence 36, the transfer and indexing apparatus 30 will, as hereinafter more fully described below, drop a valve bag 1 onto table 32 while the table is in its horizontal position. The edge of the valve bag, as seen in FIG. 2, will overlap slots 44 with fence 36 positioned closest to the upper edge of table 32 as seen in FIG. 2. Thus, after the bag has fallen onto the surface of table 32, linear movement of the fence 36 along channels 44 pushes and automatically positions the upper-most edge of valve bag 1 in proper registration along the direction of travel of fence 36. By combining the registration effect of fence 36 and of lip 41 after the table has been tilted into the position corresponding to the solid lines of FIG. 3, each valve bag is consistently aligned and positioned precisely as required for reliable placement thereof onto spout 2 as will be hereinafter more fully described.

Transfer and indexing apparatus 30 utilizes a transfer mechanism 35 to remove one valve bag at a time from magazine apparatus 20 and to transfer each such bag to a position above tilt table 32. Transfer mechanism 35 utilizes a suction cup assembly 40 which, as seen best in FIG. 2, utilizes four individual suction cups 45 arranged in a rectangular or "H" configuration for picking up the upper-most valve bag from the upper-most horizontal shelf 22 of magazine assembly 20. This is accomplished at the four corners of the bag so that the bag has no opportunity to bend or flex along the center thereof. Bags made of plastic or other such non-rigid materials would have a tendency to so flex. Suction cup assembly 40 is attached to the end of a suction cup extension arm 43, which may be selectively extended or retracted by suction cup actuator 46. Suction cup assembly 40 and actuator 46 are secured to a travel rod assembly 42, which is in turn secured to the support structure 31. Travel rod assembly 42 provides a means by which the entire transfer mechanism 35 is moved longitudinally between a first position in which the suction cup assembly 40 is positioned immediately above the stack of bags on the upper-most horizontal shelf 22 of magazine apparatus 20, and a second position where the suction cup assembly may drop a bag onto indexing table 32.

When each valve bag has been dropped onto the table 32 it is registered in one dimension by fence 36 pushing the bag into edge alignment in one direction and by indexing bracket 41 receiving the perpendicular edge of a bag along a fixed line thereof when indexing table 32 is tilted to its position represented by solid lines in FIG. 3. Each bag is then at the point in the sequence of the handling process provided by the present invention, when it is to be picked up by picker-spouter apparatus 50, its valve opened and the bag placed on the spout 2. Picker-spouter apparatus 50 may be mounted on an appropriate support structure such as overhang 51. Of course, apparatus 50 should be appropriately positioned relative to spout 2 and to indexing table 32 to perform the above-indicated functions.

As indicated in FIG. 3, picker-spouter apparatus 50 utilizes a combination of a suction cup assembly 52 and a set of calipers 54 to positively hold the valve end 6 of the bag 1. In addition, a push rod 56 is used to apply a resistant force to the valve portion of the bag, as will be hereinafter more fully explained in conjunction with FIG. 4, to ensure that the valve is opened sufficiently to allow the valve aperture to fit easily and securely over spout 2. After suction cup assembly 52, calipers 54, and push rods 56, are positioned properly with respect to valve end 6 of a bag, picker-spouter apparatus 50 rotates the bag in a substantially vertical plane through an angle of approximately 60° until valve end 6 of each bag 1 is in substantial alignment with and horizontally displaced from spout 2. Then picker-spouter apparatus 50 moves each bag in a linear horizontal direction, pulling the valve of the bag onto spout 2.

The step of picking up bag 1 at its valve end 6, is accomplished by suction cup assembly 52 and by suction cup extension actuator 60 which extends arm 55. Suction cup assembly 52 is extended until it comes in contact with valve end 6 of bag 1 which will have already been precisely aligned on indexing table 32 as previously described. Extension arm 55 is then retracted into the actuator body 50, pulling the valve end of the bag with it. During this interval, push rod 56 will have been extended by actuator 58 so that when the valve end of the bag is fully pulled up by suction cup assembly 52, the extended push rod fully opens the valve portion of the bag. At this time calipers 54 are closed by the action of caliper actuators 57 and the bag below the valve end to provide additional mechanical support prior to the rotational and linear movement of the bag onto spout 2. A detailed sequence of all steps in the bag placing process performed by the present invention, is provided in Table VII, below.

After calipers 54 are closed to provide the above-indicated additional mechanical support of bag 1, push rod 56 is retracted and a spouter rotation actuator 62 retracts spouter rotation arm 63 causing a boom 64 to rotate clockwise as seen in FIG. 3 until boom 64 is substantially vertical and the opened valve of bag 1 is started onto the spout 2. Then the vertically positioned boom is caused to move from right to left, as viewed in FIG. 3, by spouter transfer actuator 70 and the combination of suction cup assembly 52 and calipers 54 which are mechanically secured to the valve end of the bag above and below the open valve. Thus, the bag is forced onto spout 2 in a position where it may be filled without any spillage.

The left-most portion of FIG. 2 provides a more detailed top view of the portion of the picker spouter apparatus used for rotating the valve bag into vertical position in horizontal displaced alignment with spout 2 and for then causing horizontal displacement of the structure for placement of the valve bag onto the spout 2. FIG. 2 illustrates that the spouter rotation actuator 62 and spouter rotation arm 63 are mounted on a pair of spouter transfer slides 69, which are, in turn, mounted in slideable engagement with a pair of spouter transfer rails 68. Rails 68 are in turn affixed at their respective ends to spouter transfer support structure 67. Relative movement of the spouter transfer slides 69 upon spouter transfer rails 68, provides the horizontal motion of the vertically aligned bag toward spout 2 for placement thereon. This horizontal motion is accomplished by means of spouter transfer actuator 70 which is also affixed to the spouter transfer slides 69. Spouter transfer actuator 70 includes a spouter transfer arm 66, the end of which is affixed to spouter transfer support structure 67 whereby extension of arm 66 by actuator 70 causes the entire spouter transfer assembly mounted on spouter transfer slides 69 to move horizontally as shown by the arrowhead in FIG. 2 whereby valve bag 1 is moved in the direction of spout 2. Clearly, when spouter transfer arm 66 is retracted by actuator 70, linear motion in the opposite direction is accomplished whereby the gripping means of the present invention is placed in proper position for picking up the next bag to be placed on spout 2.

Figure 4:
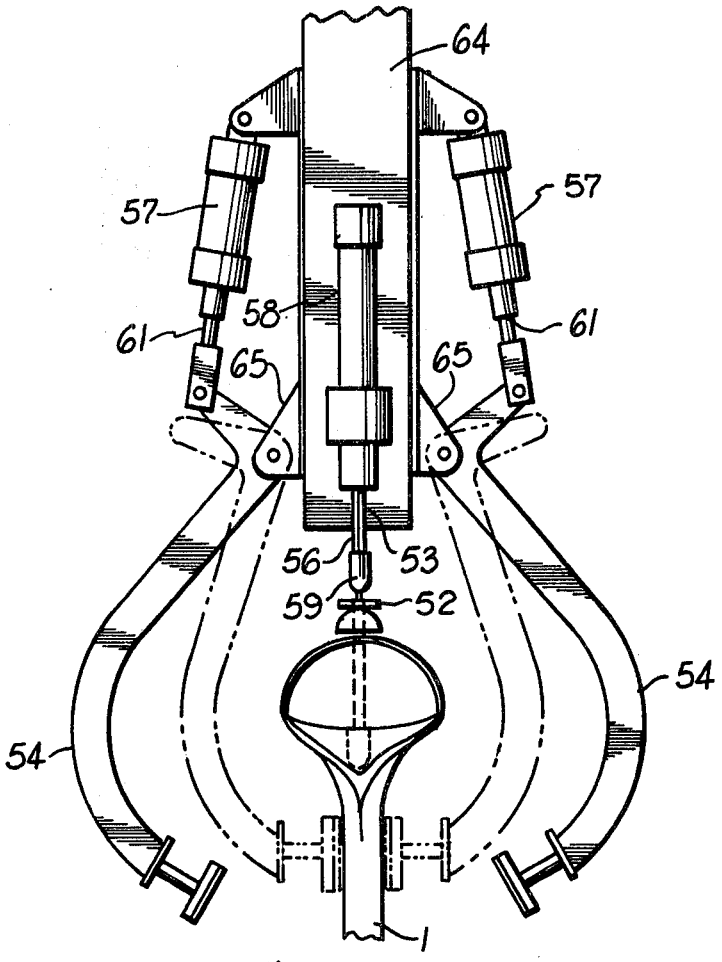
FIG. 4 is an enlarged front view of that portion of the picker-spouter apparatus of the invention for opening the valve of a bag and for grasping it for placement onto a filling spout.

FIG. 4 provides an enlarged detailed view of the novel gripping means of the present invention. As shown in FIG. 4, the gripping means combines three elements to achieve a superior degree of reliable opening of the valve of bag 1. These three elements being suction cup assembly 52, calipers 54, and push rod assembly 56. Position control of calipers 54 is attained by means of actuators 57 and actuator arms 61 on each side of boom 64 as seen in the view provided by FIG. 4. As indicated the actuator arms 61 are rotationally linked to calipers 54 in a lever configuration wherein substantially triangular brackets 65 act as fixed fulcrum points for the caliper rotation. Brackets 65 are attached to either side of boom 64.

Push rod 56 is actuated by means of actuator 58 in combination with actuator or push rod arm 53 which includes a push rod probe 59 at the end thereof. In the view provided by FIG. 4, push rod 56 is shown in its retracted position in solid line and in its extended position in dotted line.

Suction cup assembly 52 is shown in FIG. 4 in position for engagement with the bag 1 for pulling open the valve. It will be observed that the combined pulling action of suction cup assembly 52 on the upper flap of the valve portion of the bag and the pushing action of the probe portion 59 of push rod 56 on the lower flap of the valve portion of the bag produces a wide aperture that assures proper placement of the valve portion of the bag onto the spout 2 shown previously in FIGS. 1 and 3 while closed calipers 54 provide a reliable mechanical engagement with the remaining portion of the bag underneath the valve end thereof.

Figure 5:
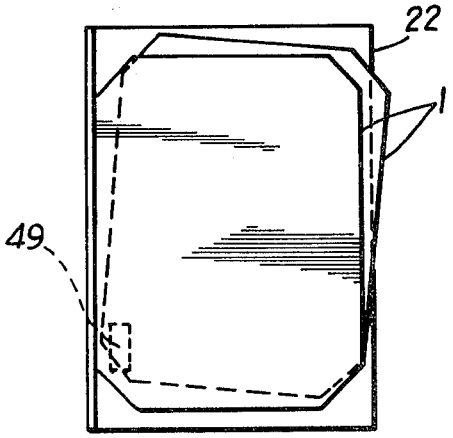
FIG. 5 is a more detailed view of a portion of the magazine of the invention illustrating the means for automatically sensing when the last bag of a stack is withdrawn.

The means for providing an indication of when the last bag on each shelf 22 has been withdrawn by transfer and indexing apparatus 30 is shown in FIG. 5 in which shelf 22 represents the upper-most horizontal shelf from which bags are being withdrawn for placement on spout 2 by means of the present invention. As shown further in FIG. 5, two valve bags 1 are stacked in horizontal configuration on the upper-most shelf 22. A reflector device 49 is illustrated in dotted line below the bottom bag 1 on shelf 22. It is clear that while at least one bag remains on shelf 22, reflector device 49 is covered so that light incident from photoelectric sensing device 47 as seen in FIG. 1, is blocked by any bag still remaining on shelf 22 and is not reflected back to the sensor. However, when the last valve bag 1 is removed from the upper-most shelf 22, reflector sensor device 47 and provides, by means of retroreflection characteristics well known in the art, reflection of light back to the sensor portion of device 47 providing a signal indicating that the last bag of the upper-most shelf has been removed. This signal results in actuation of motor 24, as seen in FIGS. 1 and 2, whereby the upper-most horizontal shelf, now empty, is rotated in a counter-clockwise direction as seen in FIG. 1, and the next horizontal shelf 22 having the next available stack of valve bags is raised to its upper-most horizontal position, thus placing the next stack of bags in proper position for each bag in that stack to be transferred by means of suction cup assembly 40 on the transfer and indexing apparatus 30 as previously described.

It is to be noted that the two valve bags shown in FIG. 5 are in a horizontal position as seen in the top view provided in FIG. 5 and are skewed relative to one another. In other words, the upper-most of the two bags illustrated in FIG. 5 is shown to be in relative alignment with shelf 22, however, the lower-most bag on shelf 22, that is, the last bag to be removed therefrom, is for purposes of illustration shown to be horizontally and angularly displaced from the upper-most bag. Despite this horizontal and angular displacement of the lower-most bag, the present invention reliably places the bag in proper alignment for ultimate placement on spout 2 as a result of the unique manner in which indexing table 32 registers each bag in two dimensions as previously described in conjunction with FIGS. 2 and 3. Accordingly, FIG. 5 illustrates one of the previously mentioned advantages of the present invention, namely, the ability of bag placer apparatus 10 to reliably place valve bags on a spout 2 despite the relatively non-aligned condition of the bags in stacks on shelves 22 of magazine apparatus 20. Thus, as previously indicated, by means of the unique apparatus herein disclosed, the present invention permits substantial labor-saving reduction in the degree of care required in stacking valve bags to be automatically placed on a spout.

Reference will now be had to FIGS. 6 and 7 which together provide a detailed schematic diagram of the electro-magnetic control circuitry of the invention. FIGS. 6 and 7 and Tables II through VI provide a detailed description of the circuits and their interaction for control of the present invention for accomplishing the automatic bag placing function as described above. Tables II through VI provide a detailed indication of the function of each of the components indicated in FIGS. 6 and 7. More specifically, Table II indicates the function of all limit switches LS-1 through LS-16; Table III provides an indication of the function of select switches SS-1 through SS-9 and push button contacts PB-1 through PB-9; Table IV provides an indication of the function of the photo-electric controls, one for the bag presenter and one for the magazine frame; Table V provides an indication of the function of solenoid valves SV-1a through SV-12; and Table VI provides an indication of the function of the various motors, alarms, and indicator lights as illustrated in FIGS. 6 and 7.

TABLE II

| LIMIT SWITCHES No. | INPUTS Function |
|---|---|
| LS-1 | Positions top magazine shelf for bag pick-up. |
| LS-2 | Partial up-swing: breaks vacuum and opens calipers if packer start switch is not made. |
| LS-3 | Full swing-up: monitor the position of the picker arm. |
| LS-4 | Index plate down. |
| LS-5 | Carriage return: positioned on magazine side of frame. |
| LS-6 | Bag pick-up cyl. retracted: (PHD magnetic reed type). |
| LS-8 | Carriage across: bag drop over Index plate and magazine advance interlock. |
| LS-9 | Index plate up. |
| LS-10 | Bag picker cyl. retracted: (PHD magnetic reed type). |
| LS-11 | Spouter car return (cyl. ret) allows picker arm to swing up. |
| LS-12 | Spouter car home (cyl. ext) allows spouter car to return. |
| LS-13 | Full swing down: allows spouter cyl. to extend (picker arm). |
| LS-14 | Valve opener cyl. ret: allows swing down of picker arm. |
| LS-15 | Printer travel complete. |
| LS-16 | Creates "demand" signal to placer for spouting. |

TABLE III

| Selector Switches and Push Button Contacts No. | Inputs Function |
|---|---|
| ss-1 | Vacuum pump on/off switch. |
| ss-2 | Magazine power on/off switch. |
| ss-3 | Bag picket cyl. on/off switch. |
| ss-4 | Bag Presenter pick-up cyl. on/off switch. |
| ss-5 | Emergency stop switch. |
| ss-6 | Emergency stop switch. |
| ss-7 | Main power on/off switch. |
| ss-8 | Palletizer/take away conveyor interlock on/off switch. |
| ss-9 | Printer on/off switch. |
| ss-10 | Packer/placer automatic mode. |
| PB-1 | Index plate down. |
| PB-2 | Calipers open. |
| PB-3 | Bag Picker cyl. extend. |
| PB-4 | Bag pick-up over magazine. |
| PB-5 | Carriage across (over tilt plate) and magazine advance. |
| PB-6 | Picker arm swing up. |
| PB-7 | Index plate up. |
| PB-8 | Spout bag on packer. |
| PB-9 | Spout attempt counter reset. |

TABLE IV

| Photo-Electric Controls No. | Inputs Function |
|---|---|
| PC-1 | Magazine advance indicator (off delay). |
| PC-2 | Magazine load-low level warning: presents magazine advance when no bags are present and sounds alarm (on delay). |

TABLE V

| Solenoid Valves No. | Outputs Function |
|---|---|
| SV-1a | Swing down (picker arm). |
| SV-1b | Swing up (picker arm). |
| SV-2 | Spout Bag on Packer. |
| SV-3a | Index plate up and bag fence back. |
| SV-3b | Index plate down and bag |

TABLE V-continued

| Solenoid Valves No. | Outputs Function |
|---|---|
| | fence in. |
| SV-4 | Bag presenter vacuum break. |
| SV-5a | Bag presenter carriage return over magazine. |
| SV-5b | Bag presenter carriage across over index plate. |
| SV-6 | Bag pick-up over magazine. |
| SV-7 | Picker cyl. (bag pick-up from index plate). |
| SV-8a | Bag valve opener cyl. extend. |
| SV-8b | Bag valve opener cyl. retract. |
| SV-9a | Calipers - closed position. |
| SV-9b | Calipers - open position. |
| SV-10 | Spouter vacuum break. |
| SV-11 | Print. |
| SV-12 | Printer assembly down. |

TABLE VI

| Miscellaneous No. | Outputs Function |
|---|---|
| M-1 | Magazine drive. |
| M-2 | Vacuum Pump Drive. |
| Alarm | Magazine low level warning/spout attempt counter counted out. |
| IL-1 | Vacuum pump "on" indicator. |
| IL-2 | Magazine power "on" indicator. |

Thus Tables II through VI taken in conjunction with FIGS. 6 and 7, provide a detailed description of the components and circuit interconnection for control of the automatic operation of the present invention sufficient to enable one skilled in the art to make and use the invention described above. In addition, still an additional table, namely, Table VII, lists a detailed step-by-step sequential description of the bag placing process of the present invention.

A SECOND EMBODIMENT

Figure 8:
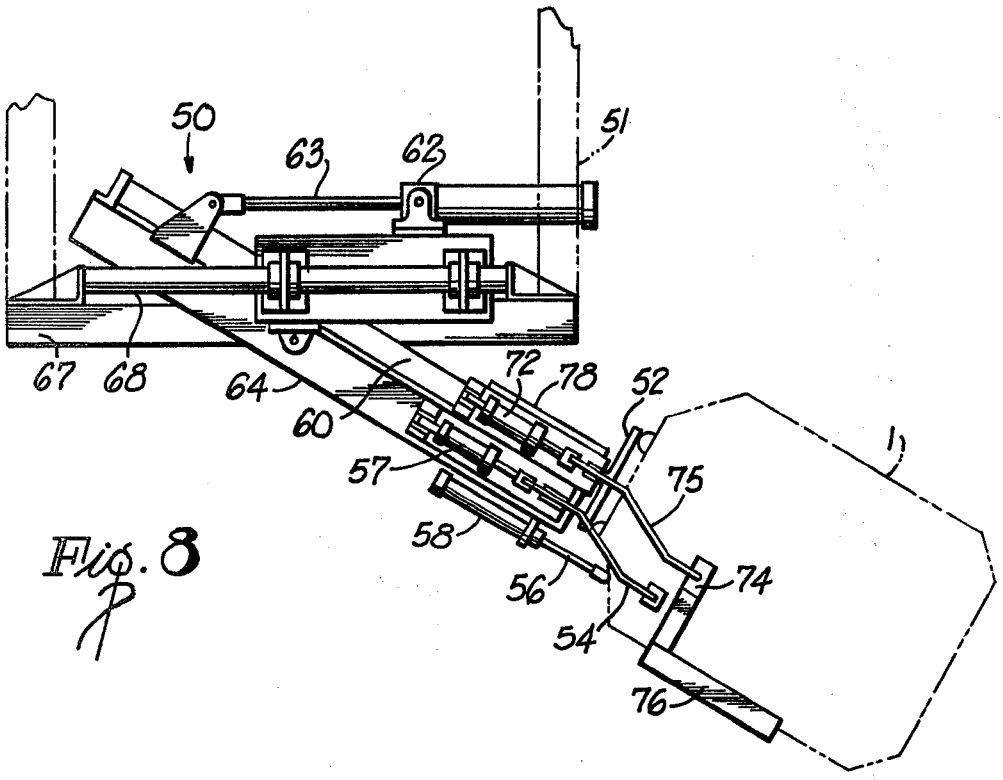
FIGS. 8 and 9 are front and side views, respectively, of an additional embodiment of the picker-spouter apparatus of the invention.
Figure 9:
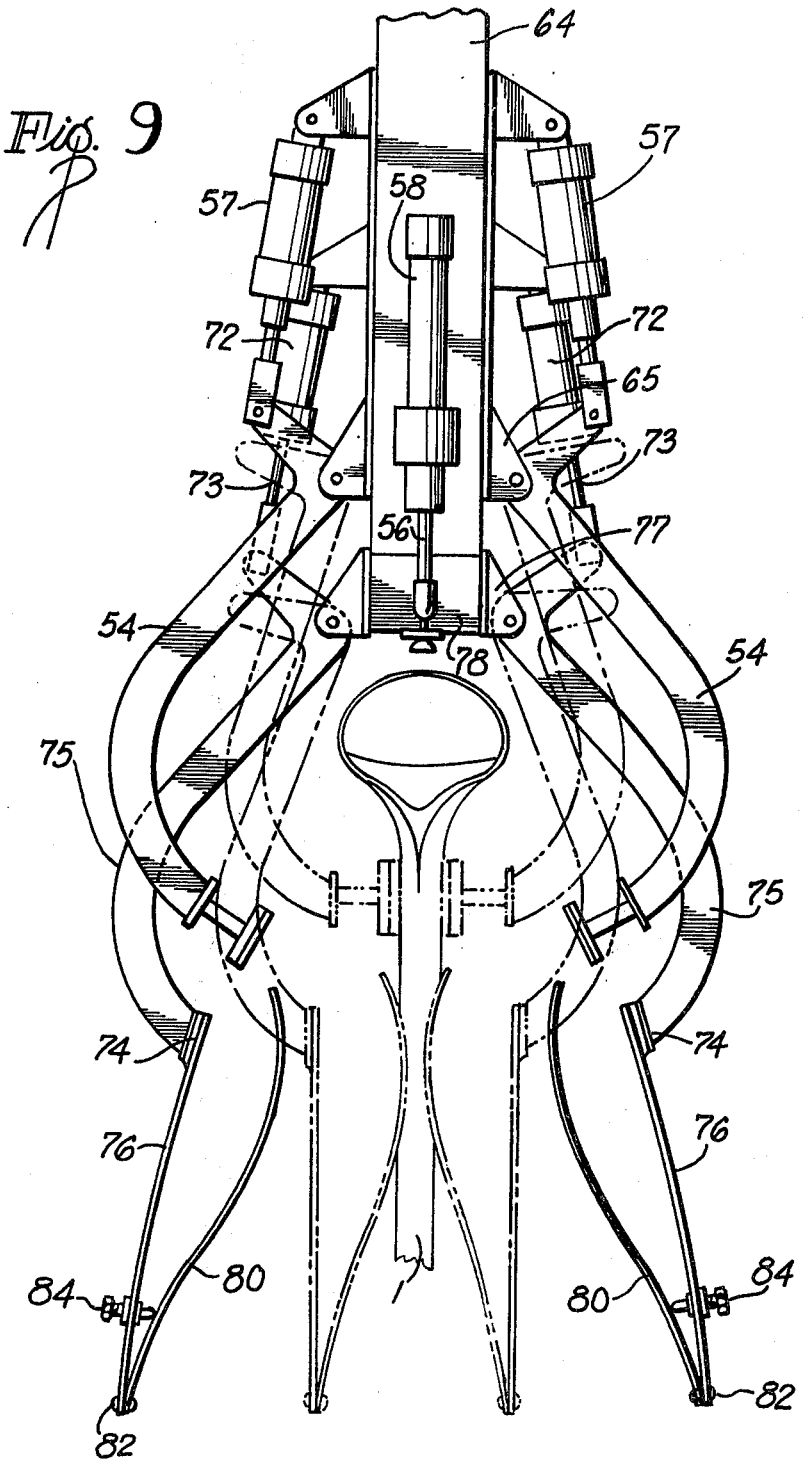

Reference will now be made to FIGS. 8 and 9 which illustrate a second embodiment of the invention in which picker-spouter apparatus 50 further comprises a second set of calipers to which are connected uniquely configured brackets and leaf-springs for further increasing the reliability of bag handling by the invention. More specifically, as shown in FIGS. 8 and 9, which provide views of the picker-spouter apparatus analogous to the views provided in FIGS. 3 and 4 of the first embodiment of the invention, it is seen that boom 64 of picker-spouter apparatus 50 is provided with a second set of actuators 72 which control a second set of calipers 75 which, in turn, terminate in clamps 74. Clamps 74 are connected to a pair of L-shaped brackets 76, the shapes thereof being seen best in FIG. 8.

Connected to each L-shaped bracket 76 at the lowermost portion thereof is a leaf-spring 80 which is connected to L-shaped bracket 76 by means of fastener 82. Leaf-springs 80 are shaped to provide opposing curved surfaces for grasping the vertical edge of bag 1 to further reduce the likelihood of each such bag bending or flexing along its mid-section which would decrease the likelihood of successful placement of the bag valve on the filling spout. As seen in FIG. 9 the spacing between leaf-springs 80 when calipers 75 are in their closed position, is determined by a pair of spacer screws 84. The adjustability of the spacing between leaf-springs 80 optimizes the flex prevention function of the springs for each different material bag being handled by the invention.

Actuators 72 are mounted on a plate 78 that is welded to the boom 64 to provide additional installation area for the second set of calipers and actuators a few inches below actuators 57 and calipers 54 of the gripping means of the invention described previously in conjunction with FIG. 4. As can be seen best in FIG. 9, actuators 72 control the position of leaf-springs 80 by means of actuator arms 73 which are connected to the uppermost ends of calipers 75 just above the fulcrum points provided by triangular brackets 77 which serve the same function as previously described triangular bracket 65. No additional electric circuitry is required for actuators 57 because they are connected in electrically parallel arrangement with actuator 58 which controls push rod 56 as previously described.

A THIRD EMBODIMENT

Figure 12:
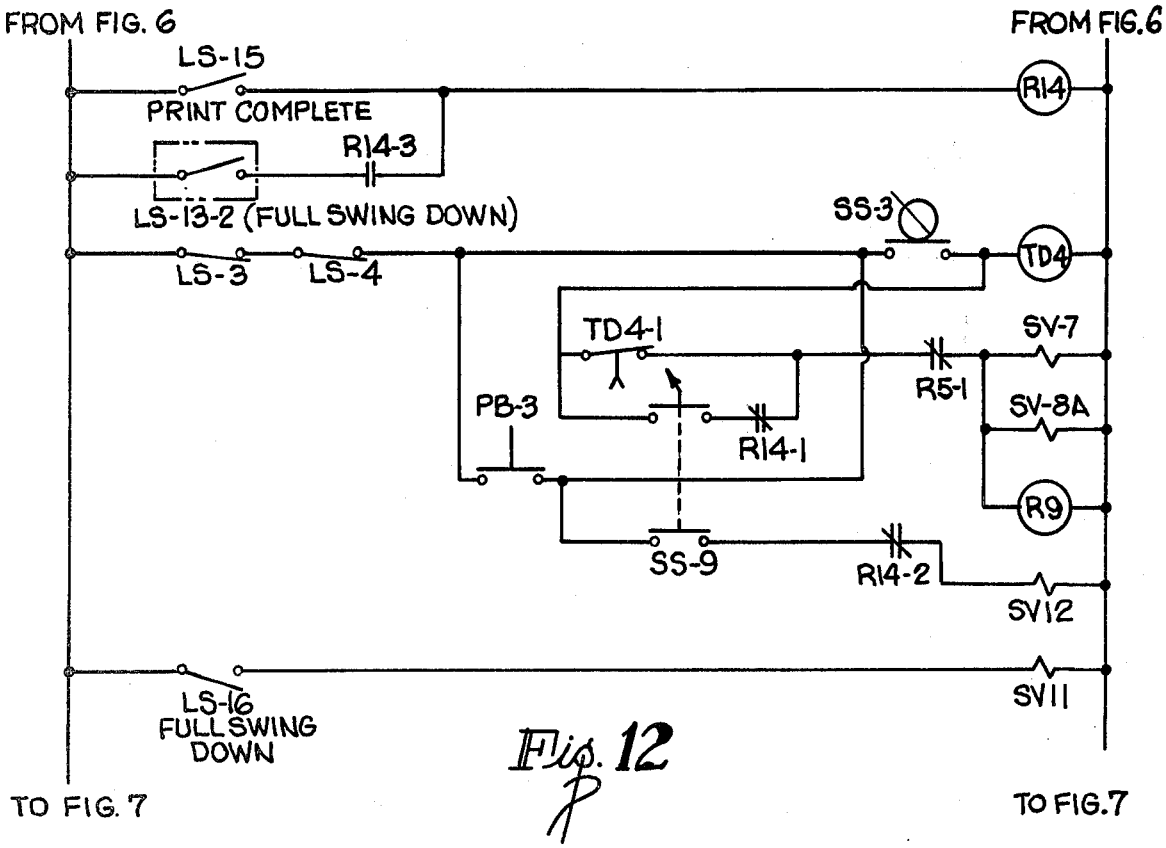
FIG. 12 is a schematic circuit diagram illustrating the changes to FIG. 7 to accommodate the bag printer assembly.
Figure 10:
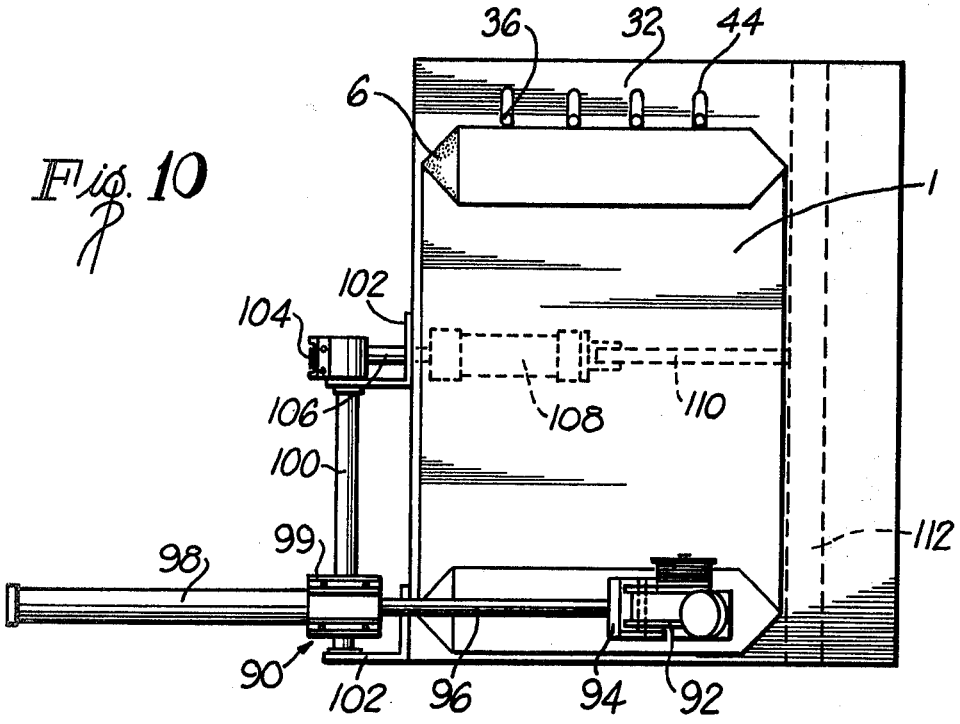
FIGS. 10 and 11 are top and side views, respectively, of an additional embodiment of the indexing apparatus including a bag printer assembly.
Figure 11:
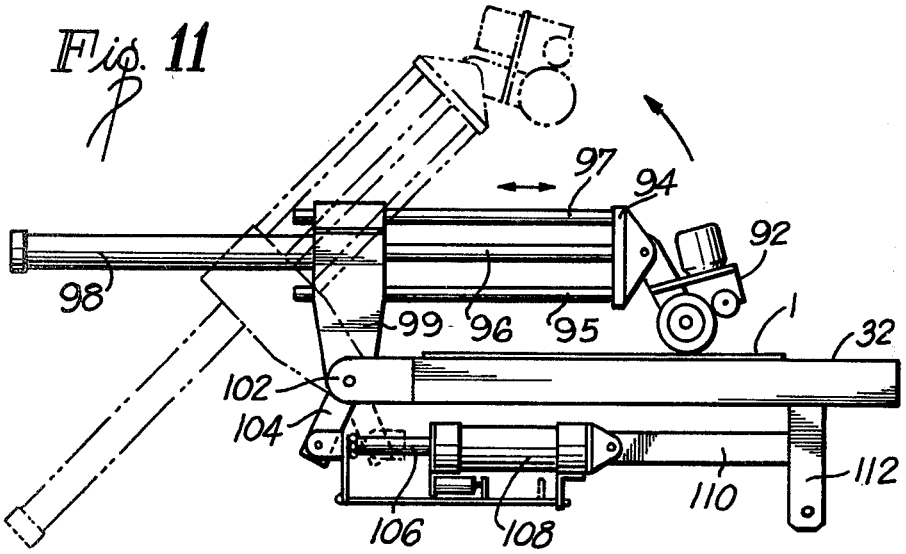

FIGS. 10 through 12 pertain to an additional embodiment of the invention in which a bag printer assembly is structurally integrated with tilt table 32. More specifically, bag printer assembly 90 as shown in FIGS. 10 and 11 comprises a printing device 92 such as a Belmark Cartridge Carton Coder, model No. 1005-2TT, which is rotatably connected to linear motion sub-assembly 94. Assembly 94 includes a pair of slideable arms 95 and 97 which are parallel to one another and also parallel to actuator arm 96 of actuator 98 which is secured to base 99. It is by means of actuator 98 that linear motion may be imparted to printing device 92 for actually imprinting the bag with the selected information after bag printer assembly 90 is swung down from the elevated position represented in phantom lines in FIG. 11 to the position represented in solid lines in that figure.

In order to accomplish the aforementioned swinging motion of assembly 90, base 99 is secured to a square cross-section shaft 100 in slideable engagement therewith to provide means for locating the imprinted message anywhere along valve bag 1 corresponding to the length of shaft 100. The ends of shaft 100 are rotatably secured to a pair of brackets 102 both of which are in turn secured to the edge of tilt table 32. One end of shaft 100, the end opposite the location of base 99 as seen in FIG. 10, is connected to a tilt cylinder wrench arm 104 which is in turn rotatably connected to actuator arm 106 of actuator 108. Actuator 108 is in turn secured by brackets 110 and 112 to the bottom surface of tilt table 32. As seen best in FIG. 11, when the actuator arm 106 of actuator 108 is fully retracted, the printer assembly is in its fully elevated position represented by the phantom lines in FIG. 11. However, when actuator arm 106 is fully extended, shaft 100 is rotated by tilt cylinder wrench arm 104 causing the printing linear motion sub-assembly 94 to attain its horizontal position in which printing device 92 is in forced engagement with the top surface of valve bag 1. The extended actuator arm 96 of actuator 98 is then retracted whereby the printing device is caused to roll along the surface of the bag to impart the printed information thereon.

Thus it is seen that this additional embodiment of the invention provides means for automatically imprinting each bag handled by the invention with selected information such as a code representing the bag contents or a date indicative of when the bag was filled. FIG. 12 provides a schematic representation which constitutes a modification to the upper-most portion of the schematic diagram of FIG. 7 in which solenoid valves SV-11 and SV-12, relay R14, select switch SS-9, and limit switch LS-15 are added to control the operation of printer assembly 90.

It will now be understood that what has been described herein is an improved automatic bag placing apparatus for placing a valve bag upon a filter spout through which the bag is to be filled with a flowable particulate material. It will be understood further that the invention comprises three principal apparatus, namely, a magazine for stacking the bags, a registration and indexing apparatus, in one embodiment having a printer assembly for removing one bag at a time from each stack and aligning the bag with the valve portion of the bag in a precise location, (and printing information on the bag when the printer assembly is included), and a picker-spouter apparatus which picks up the aligned bag, opens the valve, and places the valve aperture upon a filler spout. The picker-spouter apparatus includes a unique combination of elements for greater reliability in opening the valve of the bag and placing it securely on the filling spout; namely, a first and second clamp mechanisms, suction cups, and a push rod which, acting together in appropriate sequence as indicated in Table VII, ensure that the bag will be placed upon the filling spout without falling empty to the convey belt below, which would otherwise reduce the efficiency of the bag placing process performed by the invention.

TABLE VII

Sequence of Operation

NOTE: The initial state of outputs are as follows:

(a) Bag pick-up cylinder is retracted (LS-6).
(b) Carriage assembly is over the tilt plate (LS-8).
(c) Index plate in the down position (LS-4).
(d) Picker cylinder is retracted (LS-10).
(e) Picker arm is in the "up" position (LS-3).
(f) Spouter cylinder is retracted.
(g) Calipers are closed.
(h) Valve opener cylinder is retracted (LS-14).

1. With the carriage assembly over the magazine (LS-5), the bag pick-up cylinder is extended allowing the suction from the (4) vacuum cups to grasp the top bag from the magazine.
2. The duration of the bag pick-up cylinder extension is a timed function. As the timer times out, the cylinder is retracted pulling the top bag away from the stack.
3. When the cylinder is fully retracted, LS-6 is closed which sends the carriage assembly across over the index plate closing LS-8.
4. The bag is held at this position until the vacuum is interrupted by the index plate coming up. (LS-9). Ref #13
5. When the vacuum to the carriage is interrupted (SV-4) the bag is released and drops to the index plate.
6. As the bag is released (SV-4), this sends the carriage back over the magazine to pick-up the next bag.
7. After a brief time delay, the index late rotates down registering the bag against a lower guide as well as moving the fence in to register the bag end.
8. With the tilt plate down (LS-4), the picker cylinder extends, carrying 2 vacuum cups to the cylinder rod, to grasp the bag located on the index plate.
9. The picker cylinder extension is a timed function and at the end of a preset duration, the cylinder retracts pulling the bag from the index plate.
10. As the picker cylinder is extended (SV-7), the valve opener cylinder is also extended.
11. When the picker cylinder is fully retracted (LS-10) the calipers close and the valve opener cylinder is also retracted.
12. Note: This is the "ready" state of the invention, i.e. a bag waiting above the index plate and a bag with the valve open ready to be placed on packer spout.
13. As the demand for placing is received from the packer, the picker arm swings down (LS-13) controlling the following functions:
    (a) Spouter cylinder extend.
    (b) Index plate up and bag fence back.
14. The spouter cylinder extends (LS-12) initiating the return delay period. During this delay period, 1 of the following conditions will occur:
    (a) packer bag clamp with "no bag/no start" sensor comes down. If a bag is present, the packer starts which opens the calipers, interrupting the vacuum supply, thus releasing the bag, and returns the spouter cylinder.
    (b) the bag clamp sensor detects a "no bag" condition which prevents the packer from starting and retracts the spouter cylinder. In this case, the calipers remain in the closed position until a partial up-swing signal from picker arm (LS-2) is closed. This opens the calipers and releases the vacuum, thus dropping the bag.
15. As the spouter cylinder retracts (LS-11) the picker arm swings up (LS-3) which extends the picker cylinder for bag pick-up from the index plate.
16. Magazine advance is controlled by a photo-electric control. The light source is mounted directly over the top magazine shelf. Attached to each magazine shelf, is a retro-reflector. As the last bag on the top shelf is removed, the photo-electric control contacts are closed energizing the magazine motor.
17. Positioning of the top magazine shelf is accomplished through the normally closed contact of LS-1. The opening of this contact de-energizes the magazine motor starter. This positions the top shelf for proper alignment with the pick-up assembly.

In the bag placer systems in which the aforementioned second and third embodiments are utilized, the sequence of operation includes the following additional operations:

8a. When the tilt table is fully tilted down, as the picker extends, the printer swing down occurs (SV-12) and when completed (LS-16) the linear print action is initiated (SV-11). When print is complete (LS-15) relay R14 is energized thereby resetting the printer assembly.

10a. As the valve opener cylinder is extended in operation 10, the leaf-spring calipers are closed so that the leaf-springs grasp the bag along a vertical edge to prevent the bag from flexing.

11a. As the valve opener cylinder is retracted in operation 11, the leaf-spring calipers are opened, the valve bag now being firmly grasped by the other set of calipers.

In addition, it will now be understood that because of the unique manner in which the bags are handled, the present invention is capable of placing bags made of lightweight material such as plastic, which have, until the present invention, constituted a problem for the manufacturers of bag placing apparatus because of the inherently increased difficulty of handling such highly flexible plastic materials. In addition, it will now be understood that as a result of the novel structure of the present invention, valve bags placed in stacks for placement on spouts by the present invention need not be precisely aligned as required in the prior art.

Although preferred embodiments of the best mode of the invention have been disclosed in sufficient detail to enable one skilled in the art to make and use the invention, it will now be understood that various modifications may be made to the specific configurations and components disclosed herein, but that all such changes are contemplated to be within the scope of the invention which is to be limited only by the appended claims:

I claim:

1. An improved bag placer apparatus for placing a bag or the like having a valve at an end thereof upon a filler spout through which the bag is to be filled with a flowable material, the apparatus of the type having means for withdrawing one such bag at a time from a plurality of such bags and having means for gripping the valve end of the withdrawn bag for opening the valve prior to placement thereof on the filler spout; the improvement comprising:

a bag registration apparatus for receiving each said one bag in a substantially horizontal position from said withdrawing means and for presenting each said one bag to said gripping means, and having means for automatically registering each said one bag for location of said valve end in precise position and alignment relative to said gripping means;

wherein said means for automatically registering comprises:

means for utilizing the force of gravity to align a first edge of said bag in a first dimension, and means for forceably aligning a second edge of said bag in a second dimension, said first and second edges of said bag being perpendicular to one another and lying in the plane of said bag, and wherein said means for utilizing the force of gravity comprises:

a tiltable table adapted to receive said bag in a sustantially horizontal position and to tilt at an angle with respect to said horizontal position, said angle being sufficient to cause said bag to slide in the direction of said tilt, and said tiltable table having an indexing means mounted to the top surface of said table for receiving the edge of said sliding bag in substantial alignment therewith, and means for automatically applying selected indicia to each said bag on said registration apparatus.

2. An improved bag placer apparatus as defined in claim 1 wherein said applying means comprises:

a printer assembly connected to said bag registration apparatus, said assembly having a printer device and means for moving said printer device in elevation relative to each said bag and linearly along a surface of each said bag for printing selected information on each said bag surface.

3. The improved bag placer apparatus defined in claim 2, wherein said printer device moving means comprises:

a base having an aperture therethrough, a shaft inserted through said base aperture for rotation of said base and connected to said bag registration apparatus in relative rotational engagement therewith, means for rotating said shaft and base through a selected angle, an elongated rod having one end connected to said printer device and having an opposite end in slideable engagement with said base, and means for linearly extending and retracting said rod and said printer device relative to said base over a selected length whereby said printer device may be elevated above said registration apparatus at said selected angle relative thereto and linearly moved through said selected length along said bag surface.

4. An improved bag placer apparatus for placing a bag or the like having a valve at an end thereof upon a filler spout through which the bag is to be filled with a flowable material, the apparatus of the type having means for withdrawing one such bag at a time from a plurality of such bags and having means for gripping the valve end of the withdrawn bag for opening the valve prior to placement thereof on the filler spout; the improvement comprising:

a bag registration apparatus for receiving each said one bag in a substantially horizontal position from said withdrawing means and for presenting each said one bag to said gripping means, and having means for automatically registering each said one bag for location of said valve end in precise position and alignment relative to said gripping means;

a magazine apparatus having a plurality of tiered shelves for supporting a plurality of vertical stacks of such bags, each such stack comprising a plurality of said bags in horizontal position, the magazine apparatus also having means for sensing when the last bag of a stack has been withdrawn, and having means responsive to said sensing means for positioning another such stack into juxtaposition with said withdrawing means;

gripping means having, in combination, suction means for extending an openable portion on a first side of the orifice of said valve, a push rod for restraining a second side of the orifice of said valve, and a clamp mechanism for grasping said bag below said valve orifice, whereby said valve orifice is fully opened and said bag is securely gripped for being placed on said filling spout; and means for automatically applying selected indicia to each said bag on said registration apparatus.

5. An improved bag placer apparatus as defined in claim 4 wherein said applying means comprises:

a printer assembly connected to said bag registration apparatus, said assembly having a printer device and means for moving said printer device in elevation relative to each said bag and linearly along a surface of each said bag for printing selected information on each said bag surface.

6. The improved bag placer apparatus defined in claim 5, wherein said printer device moving means comprises:

a base having an aperture therethrough, a shaft inserted through said base aperture for rotation of said base and connected to said bag registration apparatus in relative rotational engagement therewith, means for rotating said shaft and base through a selected angle, an elongated rod having one end connected to said printer device and having an opposite end in slideable engagement with said base, and means for linearly extending and retracting said rod and said printer device relative to said base over a selected length whereby said printer device may be elevated above said registration apparatus at said selected angle relative thereto and linearly moved through said selected length along said bag surface.

7. An improved bag placer apparatus for placing a bag or the like having a valve at an end thereof upon a filler spout through which the bag is to be filled with a flowable material, the apparatus of the type having means for withdrawing one such bag at a time from a plurality of such bags and having means for gripping the valve end of the withdrawn bag for opening the valve prior to placement thereof on the filler spout; the improvement comprising:

said gripping means having in combination:

suction means for extending an openable portion on a first side of the orifice of said valve, a push rod for restraining a second side of the orifice of said valve, a first clamp mechanism for firmly grasping said bag immediately below said valve orifice, and a second clamp mechanism for grasping said bag below said first clamp mechanism along an edge of said bag, whereby said valve is fully opened and said bag is securely gripped for being placed on said filling spout.

8. An improved bag placer apparatus as defined in claim 7 wherein said second clamp mechanism comprises:

a pair of air cylinder actuatable calipers in opposed alignment, a pair of brackets respectively connected to the inside facing surfaces of said calipers, and a pair of leaf-springs respectively connected to the inside facing surfaces of said brackets and adapted to selectively grasp and release a valve bag vertically aligned therebetween to prevent said bag from folding while in said gripping means.

9. An improved bag placer apparatus as defined in claim 7 wherein said suction means comprises a plurality of air cylinder actuatable suction cups mounted on the end of an extendable arm along a plane perpendicular to the axis of said arm; and wherein said push rod comprises an air cylinder extendable rod; and where said first clamp mechanism comprises a pair of air cylinder actuatable calipers in opposed alignment and adapted to selectively grasp and release a valve bag vertically aligned therebetween.

10. An improved bag placer apparatus as defined in claim 9 wherein said second clamp mechanism comprises:

a pair of air cylinder actuatable calipers in opposed alignment, a pair of brackets respectively connected to the inside facing surfaces of said calipers, and a pair of leaf-springs respectively connected to the inside facing surfaces of said brackets and adapted to selectively grasp and release a valve bag vertically aligned therebetween to prevent said bag from folding while in said gripping means.

* * * * *